US006401739B1

(12) United States Patent
Bright et al.

(10) Patent No.: US 6,401,739 B1
(45) Date of Patent: Jun. 11, 2002

(54) CANTILEVER UMBRELLA

(76) Inventors: Robert G. Bright, 141 Burney-Mitchell Rd., Pollock, LA (US) 71467; John S. Lazarone, 1166 Belgard Bend Rd., Boyce, LA (US) 71409

( * ) Notice: Subject to any disclaimer, the term of this patent is extended or adjusted under 35 U.S.C. 154(b) by 0 days.

(21) Appl. No.: 09/591,988

(22) Filed: Jun. 12, 2000

(51) Int. Cl.[7] ..... E04H 15/28
(52) U.S. Cl. ..... 135/98
(58) Field of Search ..... 135/98, 20.1

(56) References Cited

U.S. PATENT DOCUMENTS

| | | | | | |
|---|---|---|---|---|---|
| 200,945 | A | * | 3/1878 | Smith | 135/98 |
| 949,620 | A | * | 2/1910 | Chastant | 135/98 |
| 4,449,542 | A | * | 5/1984 | McSwain et al. | 135/98 |
| 5,116,258 | A | | 5/1992 | Vennik | 135/20.3 |
| 5,499,644 | A | | 3/1996 | Geniele | 135/20.1 |
| 5,678,585 | A | | 10/1997 | May | 135/20.1 |
| 5,735,302 | A | | 4/1998 | Saliva | 135/20.1 |
| 5,785,069 | A | | 7/1998 | Glatz | 135/20.1 |
| 5,845,665 | A | | 12/1998 | Koehn | 135/98 |
| 5,937,881 | A | * | 8/1999 | Villa | 135/98 |
| 5,937,882 | A | * | 8/1999 | Harbaugh | 135/98 |
| 5,960,806 | A | | 10/1999 | Steiner | 135/20.1 |
| 6,152,156 | A | * | 11/2000 | Tung | 135/20.1 |

OTHER PUBLICATIONS

"SPORTYS" Outdoor Leisure Catalog, Mar.–Jun., 2000 P.5 "Cantilever Patio Canopy".

* cited by examiner

*Primary Examiner*—Alvin Chin-Shue
*Assistant Examiner*—Sarah Purol
(74) *Attorney, Agent, or Firm*—John M. Harrison

(57) ABSTRACT

A cantilever umbrella characterized by a folding canopy which is mounted in cantilever fashion on a support post rotatably mounted in a base and can be positioned at a selected location in the orbit of the canopy around the support post for shelter against rain or sunlight. In a preferred embodiment a support arm extends in angular relationship from the support post. A canopy support sleeve is mounted on a descending segment of the support arm, and multiple canopy support ribs which support the canopy are pivotally mounted on the canopy support sleeve in radially-extending relationship therefrom. Multiple spreader struts are pivotally attached at one end of each to the corresponding canopy support rib, and the other end of each spreader strut is pivotally mounted on a common strut support sleeve. A winch is mounted on the support post and a cable attached to the winch engages a pulley provided on the strut support sleeve. The canopy of the umbrella is deployed in the open configuration by winding the cable on the winch and thus causing the cable to lift the pulley and attached strut support sleeve as the spreader struts pivot outwardly on the strut support sleeve and respective canopy support ribs and the canopy support ribs pivot outwardly on the canopy support sleeve. A specially-designed lock mechanism is provided on the support post for selectively engaging the base and preventing inadvertent rotation of the support post in the base.

20 Claims, 6 Drawing Sheets

CANTILEVER UMBRELLA

BACKGROUND OF THE INVENTION

1. Field of the Invention

This invention relates to umbrellas and more particularly, to an umbrella having a foldable canopy which is suspended in cantilever fashion from a support post rotatably mounted in a base and is capable of being positioned at a selected location in an imaginary circle defined by the orbit of the canopy around the support post for shelter against rain or sunlight. In a preferred embodiment the cantilever umbrella includes a base typically characterized by a concrete base block having a vertical tubular post seat mounted therein and a rectangular base plate mounted on the base block. The support post is rotatably mounted in the post seat of the base, and a support arm extends in angular relationship from the support post and includes a descending vertical segment on which a canopy support sleeve is mounted. Multiple canopy support ribs are pivotally mounted on the canopy support sleeve in radially-extending relationship therefrom, and the canopy is mounted on the canopy support ribs. A spreader strut is pivotally attached at one end thereof to each corresponding canopy support rib, and the other end of each spreader strut is pivotally mounted on a common strut support sleeve. A winch is mounted on the support post, and a cable having one end attached to the winch engages a pulley provided on the strut support sleeve. The canopy of the umbrella is deployed in the open configuration by winding the cable on the winch and thus causing the cable to lift the pulley and attached strut support sleeve as the spreader struts pivot outwardly on the strut support sleeve and respective canopy support ribs and the canopy support ribs pivot outwardly on the canopy support sleeve. The canopy is deployed in the closed position by unwinding the cable from the winch. A specially-designed lock mechanism is provided on the support post for selectively engaging the base and preventing inadvertent rotation of the support post in the base.

2. Description of the Prior Art

A variety of umbrellas which are mounted in cantilever fashion on a support structure are known in the art. Typical of these is the "Collapsible Umbrella", described in U.S. Pat. No. 5,116,258, dated May 26, 1992, to Vennik. The Vennik umbrella is characterized by a support arm which extends from a support post and has a canopy frame mounted on the support arm for supporting a canopy in cantilever configuration on the support post. A winch is provided on the support post for raising the support arm on the support post, and this action causes a cable attached to the support post to retract a control rod of the canopy frame into the support arm and deploy the canopy in the open configuration. Lowering the support arm on the support post extends the control rod from the support arm and causes the canopy to close. U.S. Pat. No. 5,499,644, dated Mar. 19, 1996, to Henry Geniele, details a "Sunshade Assembly" including a vertical stand having a lower segment mounted in a base and an upper segment rotatably mounted on the lower segment. A top ring is provided on the bottom end of the upper segment, and a bottom ring is provided on the top end of the lower segment. A sunshade covering or umbrella mounted in cantilever configuration on the upper segment can be easily adjusted to any of multiple positions around the stand, by rotating the upper segment on the lower segment of the stand and extending a lock pin through registering openings provided in the respective top and bottom rings. An "Umbrella" is disclosed in U.S. Pat. No. 5,678,585, dated Oct. 21, 1997, to May. The umbrella is characterized by an upright mast the upper end of which slidably receives an elongated boom, and a canopy is pivotally mounted on the extending end of the boom, in cantilever fashion The boom can be pivoted on the mast and the canopy folded and pivoted on the boom to facilitate a storage position of the umbrella. U.S. Pat. No. 5,735,302, dated April 7, 1998, to Saliva, describes an "Adjustable Hanging Sunshade Umbrella" including a side standard; a transverse arm joined to the side standard in cantilevered fashion; a central rod, support and operation mechanism for a protective covering connected to the central rod; and a position-adjusting device adapted to cause rotation of the central rod relative to the axis of the transverse arm and lock it to the desired inclination of the protective covering. U.S. Pat. No. 5,785,069, dated Jul. 28, 1998, to Glatz, discloses a "Standing Umbrella" having a mast on which the inner end of an outwardly and inwardly movable carrier beam is guided with the outer end of the beam carrying an umbrella stick of a collapsible umbrella and with the carrier beam held by a connecting strut linkedly arranged between the upper end of the mast and the carrier beam. A drive mechanism shifts the inner end of the carrier beam along the length of the mast and the mast has two guide tracks spaced from one another and so profiled such that guide elements running therealong and carried by the inner end of the mast are held by the shape of the tracks against movement transversely to the direction in which the inner end of the carrier beam is shifted. A "Demountable Structure" is detailed in U.S. Pat. No. 5,845,665, dated Dec. 8, 1998, to Koehn. The structure includes a shade having a flexible cover attached to multiple support arms which are movable from a lowered position in which the cover is in a storage configuration and a raised position in which the cover is in an operative shading configuration. A support mechanism having a mounting base and a support structure upstanding from the mounting base extends in part above the shade for for supporting the shade in cantilever configuration from the mounting base. Multiple cables are connected to respective ones of the support arms and disposed above the cover for maintaining the cover in the operative shading configuration. U.S. Pat. No. 5,960,806, dated Oct. 5, 1999, to Steiner, describes a "Parasol", having a canopy which is supported in cantilever fashion from a support post.

An object of this invention is to provide a cantilever umbrella which is rotatably mounted in cantilever configuration in a base and can be positioned at a selected location in an imaginary circle defined by the orbit of the umbrella for shelter against rain or sunlight.

Another object of this invention is to provide a cantilever umbrella characterized by a support post which is rotatably mounted in a base and a foldable umbrella canopy mounted in cantilever configuration on the support post, which canopy can be deployed at a selected position in an imaginary circle defined by the orbit of the canopy around the support post by rotating and locking the support post in the base.

Still another object of this invention is to provide a cantilever umbrella characterized by a support post and an umbrella canopy mounted in cantilever configuration on the support post, which canopy can be selectively deployed in open and closed configurations by operation of a winch mounted on the support post.

Yet another object of this invention is to provide a cantilever umbrella characterized by a support post mounted in a base; a support arm extending from the support post; a canopy support sleeve mounted on the support arm; multiple canopy support ribs pivotally mounted on the canopy support sleeve in radially-extending relationship therefrom; a canopy mounted on the canopy support ribs; a spreader strut pivotally mounted on each canopy support rib, each spreader strut pivotally mounted on a common strut support sleeve; a pulley mounted on the strut support sleeve; a winch mounted on the support post; and a cable extending from the winch and engaging the pulley, which canopy is selectively deployed in opened and closed configurations by operation of the winch, whereby the cable raises the strut support sleeve, the spreader struts pivot outwardly in concert on the strut support sleeve, and the canopy support ribs pivot outwardly on the respective spreader struts and the canopy support sleeve and the canopy is opened as the cable is wound on the winch, and whereby the strut support sleeve is lowered and the canopy is deployed in the folded or closed configuration by unwinding the cable from the winch.

A still further object of this invention is to provide a cantilever umbrella having a folding umbrella canopy which is mounted in cantilever configuration on a rotatable support post and can be positioned at a selected location in an imaginary circle surrounding the support post for shelter against rain or sunlight, which cantilever umbrella includes a base characterized by a typically concrete base block, a base plate mounted on the base block typically by means of multiple anchor bolts and a tubular post seat extending through the base block beneath the base plate, which support post is rotatably mounted in the post seat of the base; an umbrella canopy mounted in cantilever fashion on the support post; a post lock collar fitted with a pair of spaced-apart post lock flanges mounted on the support post above the base plate; and a lock plate fitted with multiple plate notches slidably mounted on the support post, wherein inadvertent rotation of the support post in the base is selectively prevented by lowering the lock plate onto the base plate between the anchor bolts while inserting the post lock flanges of the post lock collar in respective plate notches of the lock plate, and the support post is unlocked in the base for rotation therein and selective positioning of the umbrella canopy by lifting the lock plate from the base plate to remove the post lock flanges from the plate notches, and resting the lock plate on the anchor bolts.

SUMMARY OF THE INVENTION

These and other objects of the invention are provided in a cantilever umbrella having a folding canopy which is mounted in cantilever fashion on a vertical support post rotatably mounted in a base and can be deployed at selected positions in an imaginary circle defined by the orbit of the canopy around the support post for shelter against rain or sunlight. In a preferred embodiment the base is characterized by a typically concrete base block, a base plate mounted on the base block typically by means of multiple anchor bolts and a tubular post seat extending through the base block beneath the base plate. The support post is rotatably mounted in the post seat, and a support arm extends in angular relationship from the support post. A canopy support sleeve is mounted on a descending vertical segment of the support arm, and multiple canopy support ribs which support the canopy are pivotally mounted on the canopy support sleeve in radially-extending relationship therefrom. Multiple spreader struts are each pivotally attached at one end thereof to the corresponding canopy support rib, and the other end of each spreader strut is pivotally mounted on a common strut support sleeve. A winch is mounted on the support post, and a cable attached to the winch engages a pulley provided on the strut support sleeve. The canopy of the umbrella is deployed in the open configuration by rotating the winch handle to wind the cable on the winch and thus cause the cable to lift the pulley and attached strut support sleeve as the spreader struts pivot outwardly on the strut support sleeve and respective canopy support ribs and the canopy support ribs pivot outwardly on the canopy support sleeve. A post lock collar fitted with a pair of spaced-apart post lock flanges is mounted on the support post above the base plate of the base, and a lock plate fitted with multiple plate notches is slidably mounted on the support post. Inadvertent rotation of the support post in the base is selectively prevented by lowering the lock plate onto the base plate between the anchor bolts while inserting the post lock flanges of the post lock collar in respective plate notches of the lock plate. The support post is unlocked in the base for rotation therein as desired for re-positioning of the umbrella canopy around the support post, by lifting the lock plate from the base plate to remove the post lock flanges from the plate notches, and resting the lock plate on the anchor bolts.

BRIEF DESCRIPTION OF THE DRAWINGS

The invention will be better understood by reference to the accompanying drawings, wherein.

DESCRIPTION OF THE PREFERRED EMBODIMENTS

Figure 1:
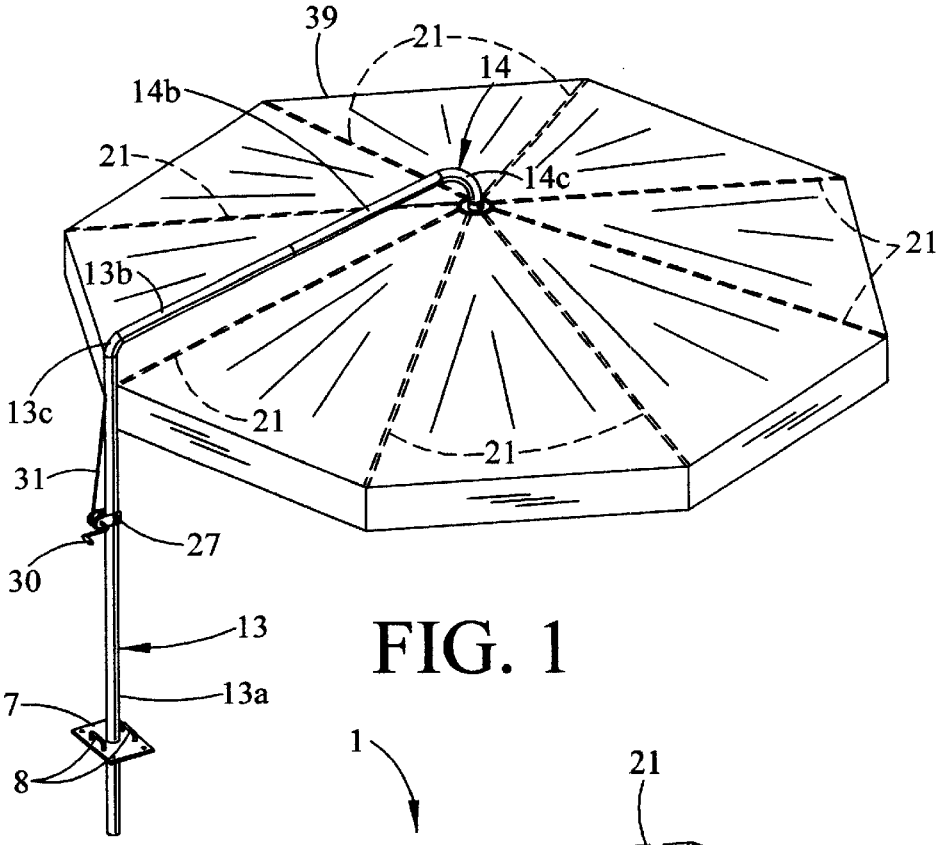
FIG. 1 is a perspective view of the support post, support arm and canopy components of the cantilever umbrella of this invention, with the support post removed from the base (not illustrated), the lock plate component slidably mounted on the support post and the canopy deployed in the open configuration.
Figure 2:
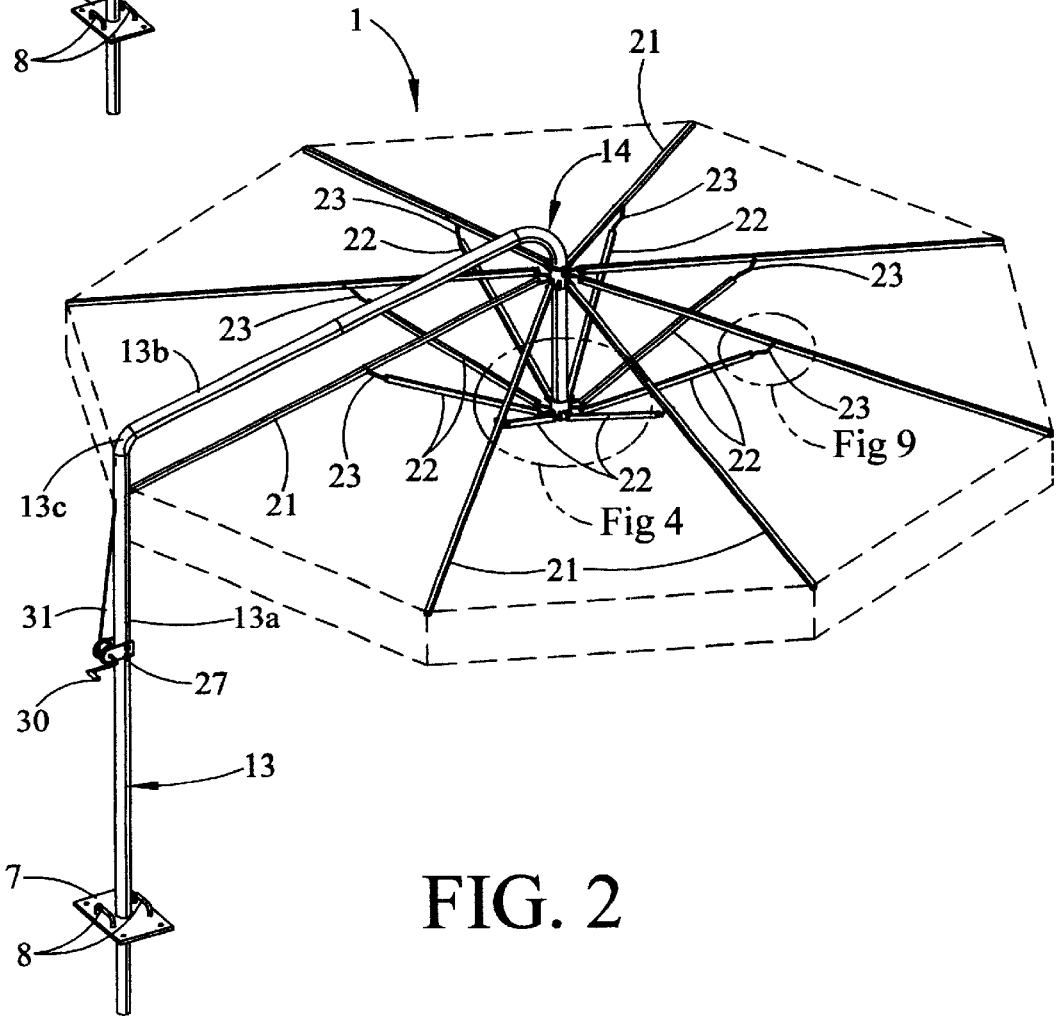
FIG. 2 is a perspective view of the cantilever umbrella illustrated in FIG. 1, more particularly illustrating the canopy (illustrated in phantom) mounted on the canopy support ribs of the umbrella with the canopy deployed in the open configuration.
Figure 6:
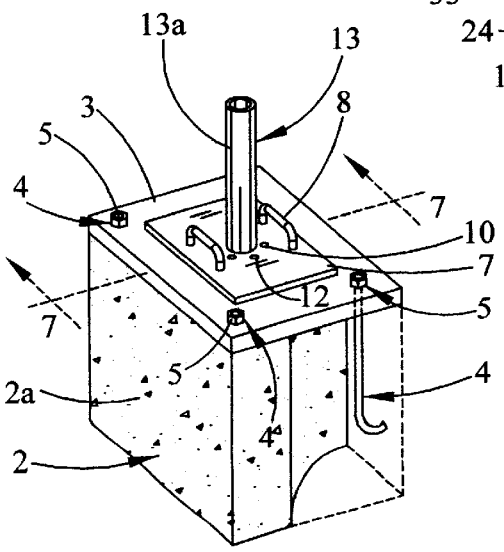
FIG. 6 is a perspective view, partially in section, of the base component of the cantilever umbrella.
Figure 7:
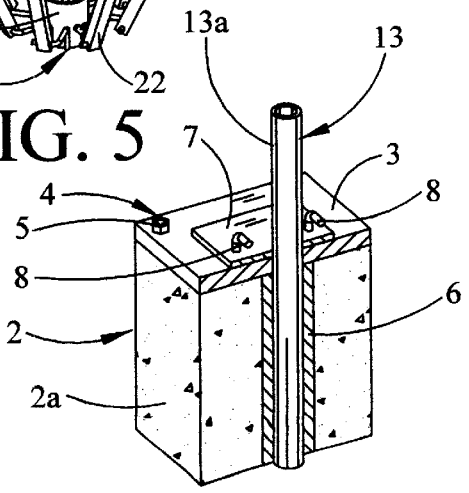
FIG. 7 is a perspective view, taken along section lines 7—7 in FIG. 6, of the base.
Figure 11:
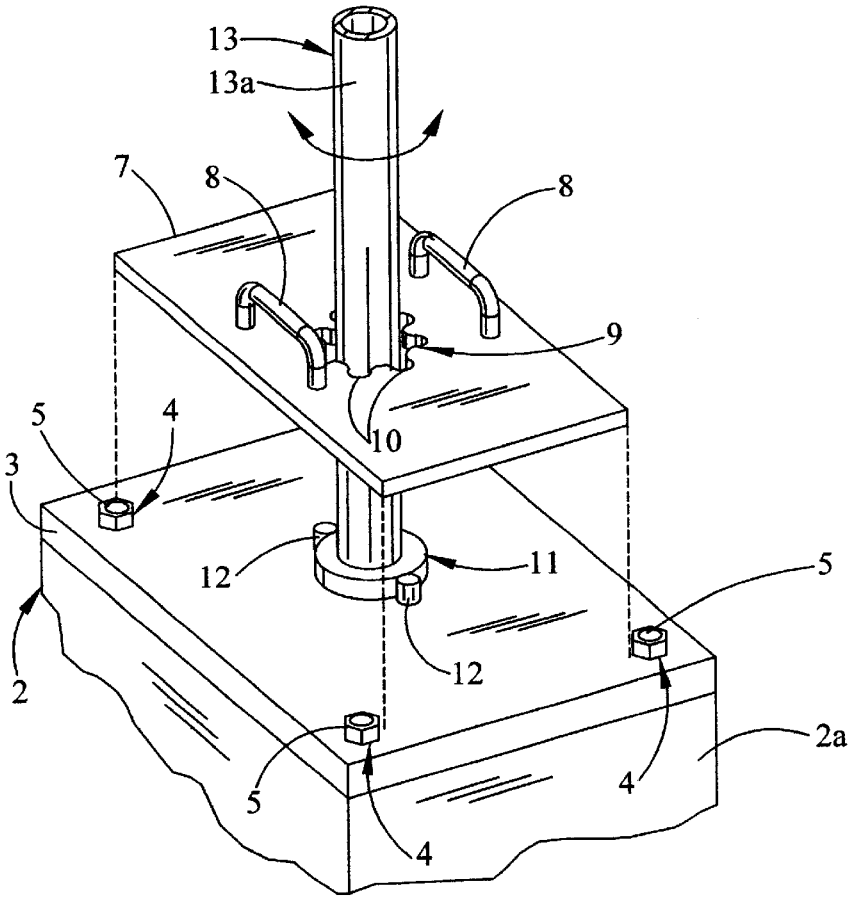
FIG. 11 is a perspective view, partially in section, of the base component of the cantilever umbrella, with the lock plate component of the umbrella slidably mounted on the support post, more particularly illustrating a preferred technique for selectively locking and preventing inadvertent rotation of the support post in the base by operation of the lock plate.
Figure 13:
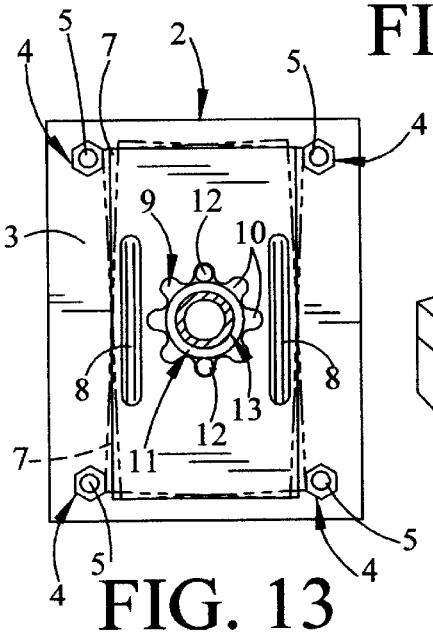
FIG. 13 is a top view of the base, more particularly illustrating alternative positioning capabilities of the the lock plate in the post-locking configuration (indicated by the solid lines) and in the post-unlocking configuration (illustrated in phantom)
Figure 12:
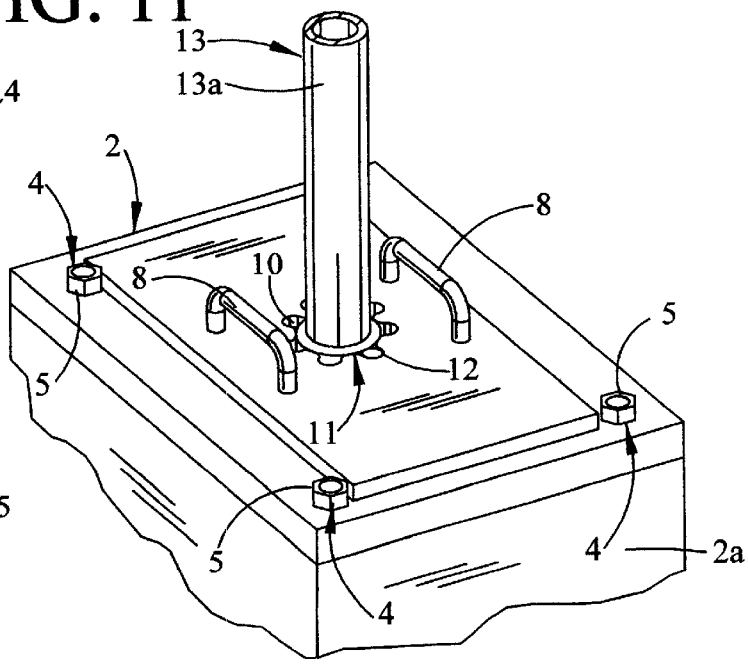
FIG. 12 is a perspective view, partially in section, of the base illustrated in FIG. 11, with the lock plate positioned in the post-locking configuration on the base.

Referring initially to FIGS. 1, 2, 6, 7 and 11–13 of the drawings, in a preferred embodiment the cantilever umbrella of this invention is generally illustrated by reference numeral 1 in FIGS. 1 and 2. The cantilever umbrella 1 includes a base 2 which, as illustrated in FIGS. 6 and 7, is characterized by a typically concrete rectangular base block 2*a*. A rectangular base plate 3 is mounted on the upper surface of the base block 2*a*, typically by means of multiple anchor bolts 4 which extend through the base plate 3 at respective corners thereof and as illustrated in FIG. 6, extend downwardly into the base block 2*a* with the hex head 5 of each anchor bolt 4 engaging the upper surface of the base plate 3. A tubular post seat 6, illustrated in longitudinal cross-section in FIG. 7, extends vertically through the base block 2*a* beneath the base plate 3. The cantilever umbrella 1 further includes an elongated support post 13, the vertical segment 13*a* of which extends through a post opening (not illustrated) provided in the base plate 3 and is rotatably mounted in the post seat 6. As illustrated in FIGS. 11–13, a circular post lock collar 11, fitted with a pair of diametrically-opposed post lock flanges 12, is typically welded or otherwise mounted on the vertical segment 13*a* of the support post 13 and typically engages the upper surface of the base plate 3 when the vertical segment 13*a* of the support post 13 is inserted in the post seat 6 as illustrated in FIG. 7. The vertical segment 13*a* of the support post 13 further extends through the plate opening 9 of a rectangular lock plate 7, slidably mounted on the vertical segment 13*a* at the plate opening 9. The plate opening 9 is provided with multiple plate notches 10, and a pair of handles 8 is typically provided on the upper surface of the lock plate 7, the purpose of which plate notches 10 and handles 8 will be hereinafter described. Accordingly, the lock plate 7 is capable of resting on the upper surface of the base plate 3 of the base 2 with the post lock flanges 12 of the post lock collar 11 (mounted on the vertical segment 13*a* of the support post 13, FIG. 11) inserted in respective companion plate notches 10 of the lock plate 7 and the lock plate 7 fitted between the respective pairs of spaced-apart heads 5 of the anchor bolts 4 as illustrated in FIGS. 12 and 13, to prevent inadvertent rotation of the support post 13 in the post seat 6 (FIG. 7) of the base 2. The support post 13 can be unlocked in the base 2 for selective rotation in the post seat 6, as desired, by lifting the lock plate 7 from the base plate 3 using the handles 8 to disengage the plate notches 10 from the post lock flanges 12 of the post lock collar 11, and slightly rotating the lock plate 7 and resting diagonally-opposed corners of the lock plate 7 on the hex heads 5 of the respective anchor bolts 4, as illustrated in phantom in FIG. 13.

Figure 4:
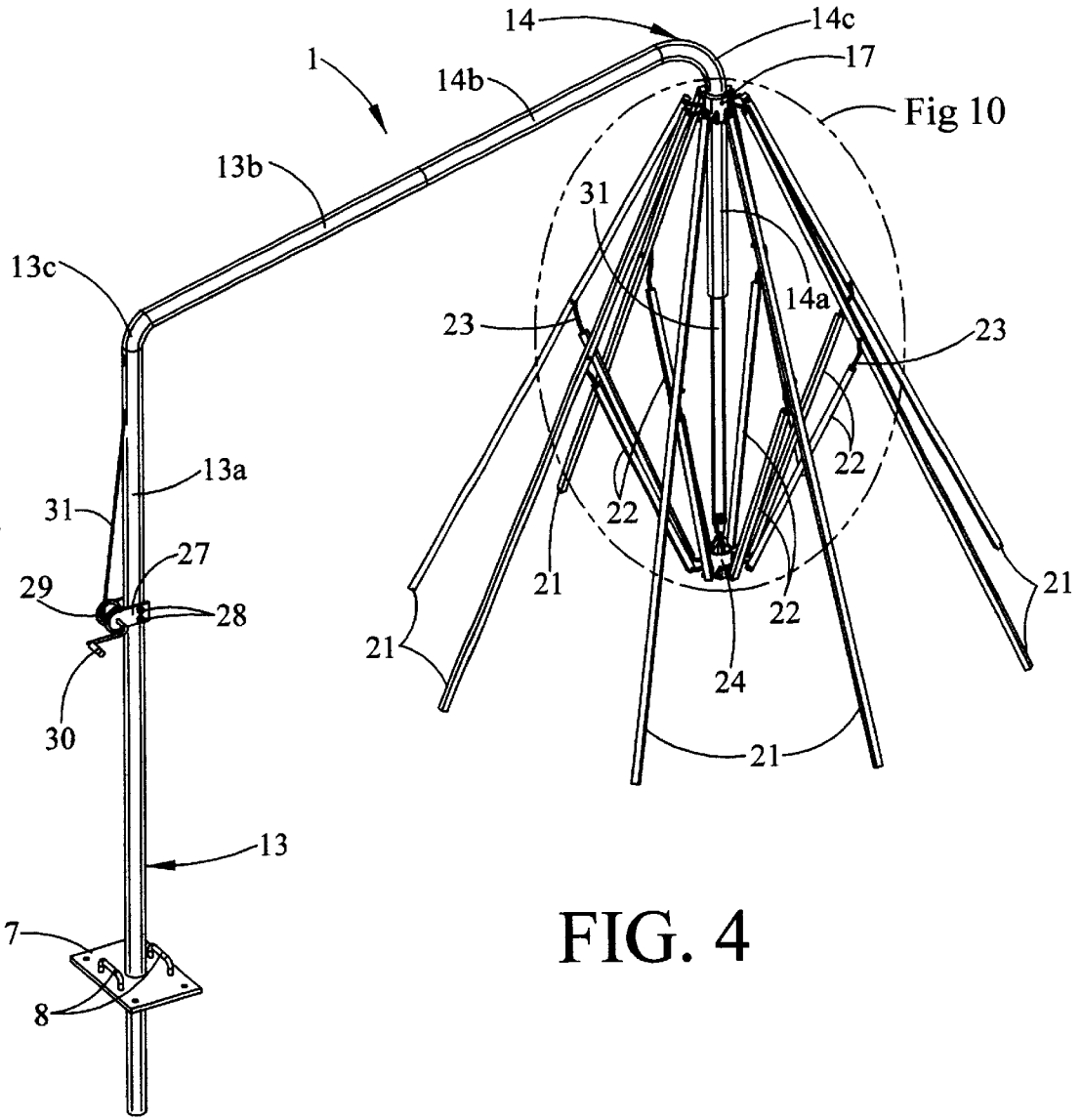
FIG. 4 is a perspective view of the cantilever umbrella, with the support post component removed from the base (not illustrated) and the canopy (also not illustrated) removed from the canopy support ribs, and the canopy support ribs and spreader struts deployed in the closed configuration.
Figure 3:
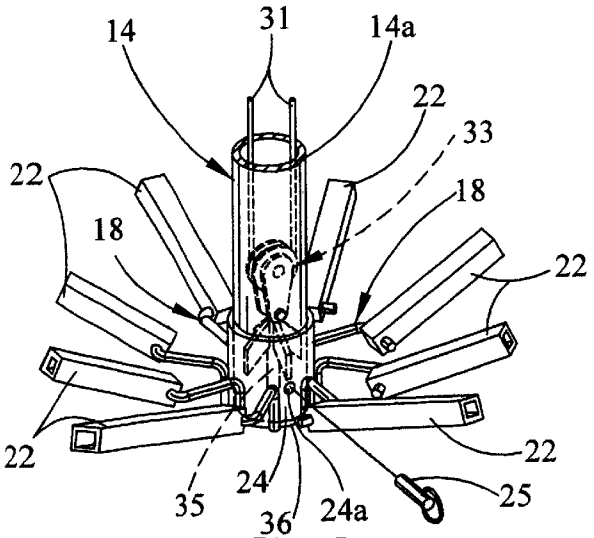
FIG. 3 is a perspective view, partially in section, of the support arm, strut support sleeve and multiple spreader strut components of the cantilever umbrella, more particularly illustrating a preferred, connector rod technique for pivotally mounting the respective spreader struts on the strut support sleeve.
Figure 8:
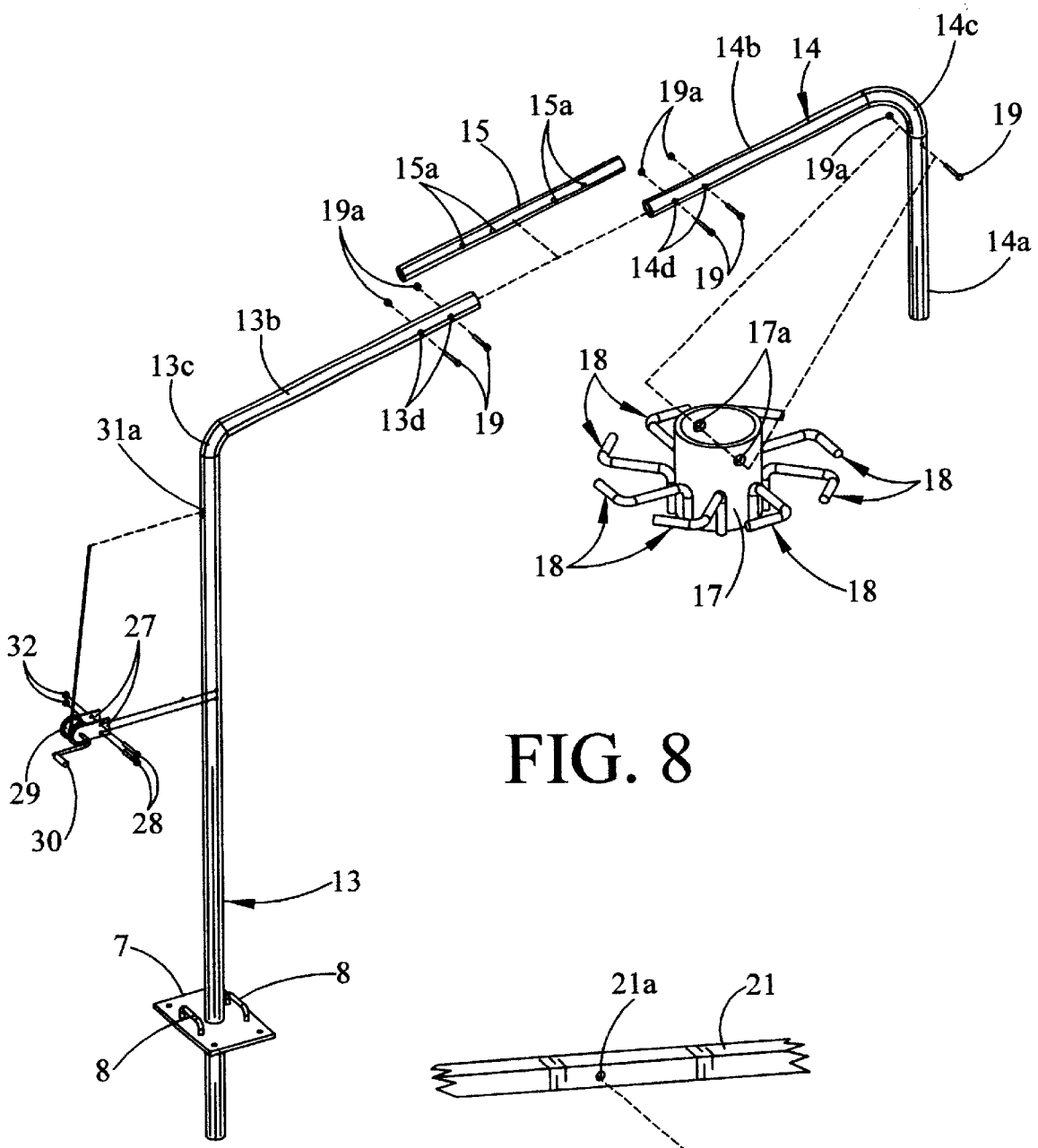
FIG. 8 is an exploded, perspective view of the support post, support arm and canopy support sleeve components of the cantilever umbrella, more particularly illustrating a preferred technique for mounting the support arm on the support post and the canopy support sleeve on the support arm.
Figure 9:
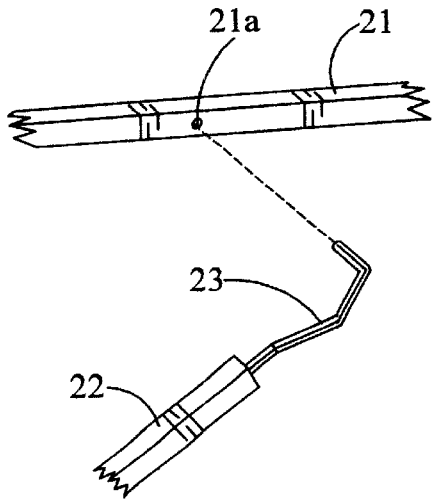
FIG. 9 is an exploded, perspective view, partially in section, of one of the canopy support ribs of the cantilever umbrella, more particularly illustrating a preferred technique for pivotally mounting each spreader strut (also partially in section) on the corresponding canopy support rib.
Figures 10, 14:
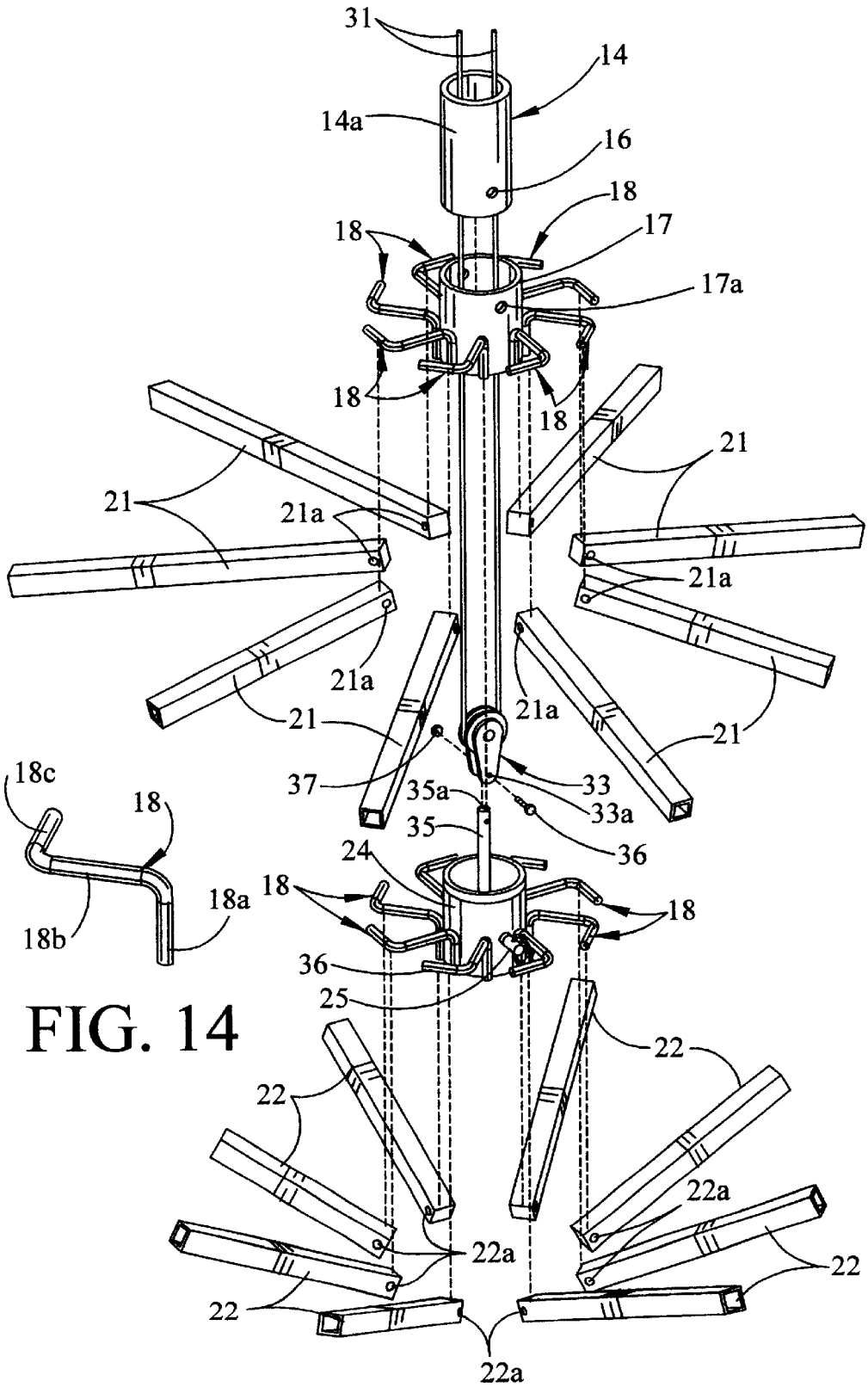
FIG. 10 is an exploded, perspective view of the support arm (partially in section), canopy support sleeve, multiple canopy support ribs (partially in section), strut support sleeve, multiple spreader struts (partially in section) and pulley components of the cantilever umbrella.
FIG. 14 is a perspective view of a connector rod component of a preferred embodiment of the cantilever umbrella, used in pivotally attaching each canopy support rib to the common canopy support sleeve and each spreader strut to the common strut support sleeve.

Referring again to FIGS. 3, 4, 8, 9, 10 and 14 and initially to FIGS. 1 and 2 of the drawings, an angled segment 13*b* extends from the vertical segment 13*a* of the support post 13 at a post bend 13*c*. As illustrated in FIG. 8, the angled segment 14*b* of a support arm 14, including a vertical segment 14*a* joined to the angled segment 14*b* at an arm bend 14*c*, is joined to the angled segment 13*b* of the support post 13 typically by means of an elongated post coupling 15. Accordingly, respective ends of the post coupling 15 are inserted in the larger-diameter angled segment 13*b* of the support post 13 and angled segment 14*b* of the support arm 14. Bolts 19 are extended through respective post bolt openings 13*d* provided in the angled segment 13*b* of the support post 13 and respective arm bolt openings 14*d* provided in the angled segment 14*b* of the support arm 14, and through registering coupling bolt openings 15*a* provided in the post coupling 15, and nuts 19*a* are threaded on the respective bolts 19. Alternatively, it is understood that the support post 13 can be constructed in one piece with the support arm 14, as desired, according to the knowledge of those skilled in the art. A cylindrical canopy support sleeve 17, the purpose of which will be hereinafter described, is mounted on the descending vertical segment 14*a* of the support arm 14, typically by extending a bolt 19 through a pair of aligned, diametrically-opposed bolt openings 17*a* provided in the canopy support sleeve 17 and through registering bolt openings 16 provided in the vertical segment 14*a* of the support arm 14, and threading a nut 19*a* on the bolt 19. As further illustrated in FIG. 8, multiple connector rods 18 are typically welded or otherwise fixedly attached to the canopy support sleeve 17, and extend outwardly therefrom in spaced-apart relationship with respect to each other around the circumference of the canopy support sleeve 17. As illustrated in FIG. 14, each connector rod 18 is typically characterized by a first rod segment 18*a* which is welded or otherwise mounted on the canopy support sleeve 17, a second rod segment 18*b* which extends from the first rod segment 18*a* in substantially perpendicular relationship thereto and a third rod segment 18*c* which extends from the second rod segment 18*b* in substantially perpendicular relationship thereto and with respect to the first rod segment 18*a*. As illustrated in FIG. 10, an elongated canopy support rib 21, typically constructed of aluminum square tubing, is pivotally mounted on each connector rod 18, typically by extending the third rod segment 18*c* (FIG. 14) of each connector rod 18 through a rod opening 21*a* provided in the corresponding canopy support rib 21 and fitting a conventional rod cap (not illustrated) or other suitable fastener which is known to those skilled in the art on the end of the third rod segment 18*c* of the connector rod 18 to secure the canopy support rib 21 on the connector rod 18. As illustrated in FIGS. 1 and 2, a canopy 39, typically constructed of a selected durable fabric material having a selected color pattern and design, is mounted on the canopy support ribs 21 according to the knowledge of those skilled in the art. As illustrated in FIG. 9, a strut connector hook 23 extends from one end of an elongated spreader strut 22, typically constructed of aluminum square tubing, and each spreader strut 22 is pivotally attached to the corresponding canopy support rib 21 by extending the strut connector hook 23 through a rod opening 21*a* which is provided at substantially the midpoint of the corresponding canopy support rib 21, as illustrated in FIG. 4. The opposite end of each spreader strut 22 is pivotally attached to a corresponding connector rod 18, as illustrated in FIG. 10, multiple ones of which connector rods 18 are typically welded to a cylindrical strut support sleeve 24 and extend therefrom in spaced-apart relationship to each other about the circumference of the strut support sleeve 24, in the same manner as heretofore described with respect to the canopy support sleeve 17 illustrated in FIG. 8. Accordingly, the third rod segment 18*c* (FIG. 14) of each connector rod 18 is extended through a connector rod opening 22*a* of the spreader strut 22, as illustrated by the dashed lines in FIG. 10, and a rod cap (not illustrated) or other suitable fastener known to those skilled in the art is fitted on the third rod segment 18*c* to secure the spreader strut 22 on the connector rod 18 as heretofore described with respect to the canopy support sleeve 17 illustrated in FIG. 10. As further illustrated in FIG. 10, a pulley 33, the purpose of which will be hereinafter described, is mounted on an elongated pulley mount shaft 35, typically by means of a pulley mount bolt 36 which is extended through a mount bolt opening 33*a* provided in the pulley 33 and through a registering shaft bolt opening 35*a*, provided in the pulley mount shaft 35. The pulley 33 is mounted on the strut support sleeve 24, typically by means of a circular shaft plate 36 which is typically welded to the bottom edge of the strut support sleeve 24 and is provided with a central shaft opening (not illustrated) through which the pulley mount shaft 35 extends, and the pulley mount shaft 35 is welded to the shaft plate 36 and extends upwardly through the strut support sleeve 24. As illustrated in FIG. 3, a safety pin 25 is typically extended through a safety pin opening 24*a* provided in the strut support sleeve 24, and through a registering pin opening (not illustrated) provided in the pulley mount shaft 35 to further secure the pulley mount shaft 35 on the strut support sleeve 24.

Figure 5:
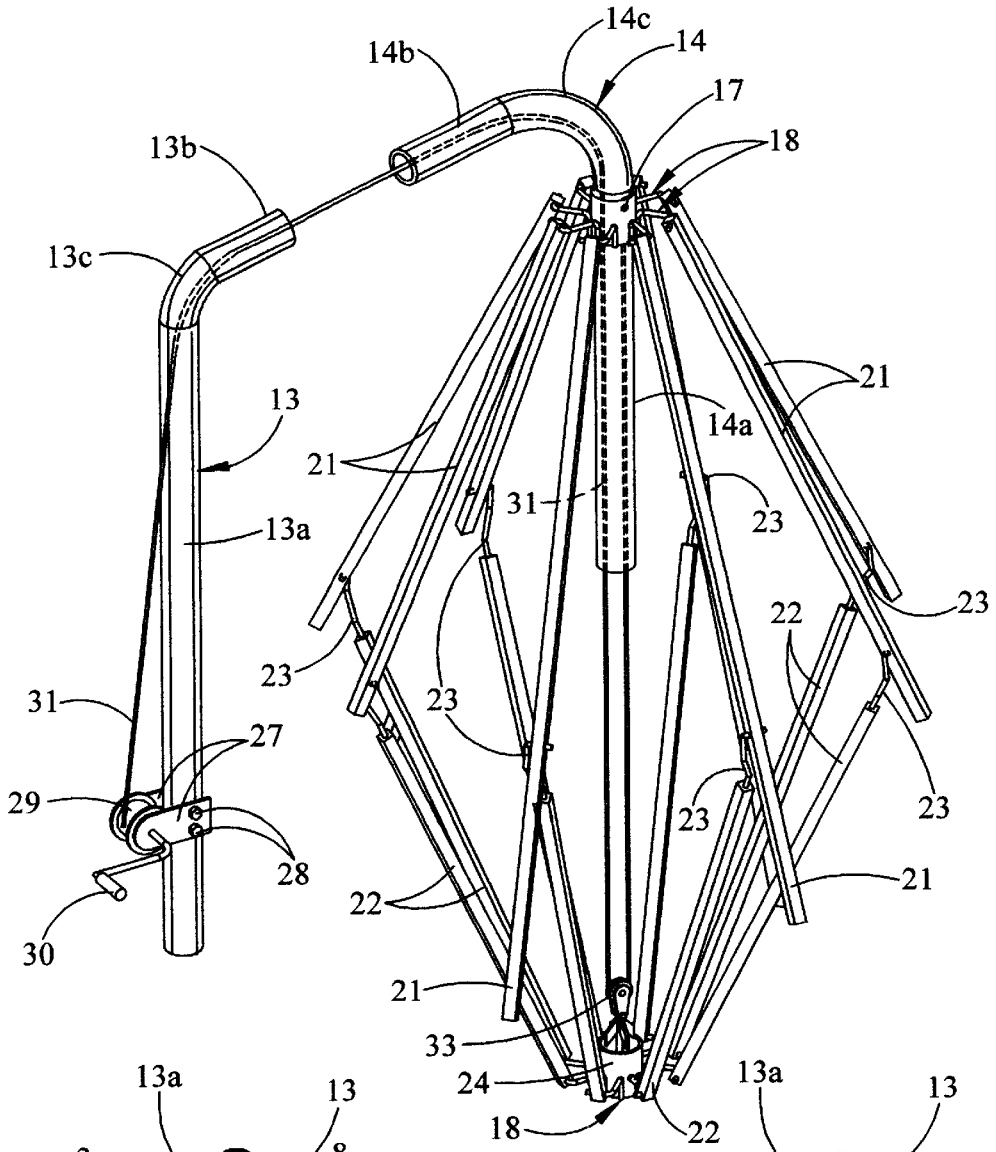
FIG. 5 is a perspective view, partially in section, of the cantilever umbrella, with the canopy (not illustrated) removed from the canopy support ribs, and the canopy support ribs and spreader struts deployed in the closed configuration.

Referring again to FIGS. 3–5 and initially to FIG. 8 of the drawings, a winch spool 29, fitted with a winch crank 30, is rotatably mounted between a pair of parallel winch mount brackets 27, mounted on the vertical segment 13*a* of the support post 13 typically by means of bracket mount bolts 28 and respective nuts 32. A cable 31, one end of which is attached to the winch spool 29 as illustrated in FIG. 4, enters the support post 13 through a cable opening 31*a* provided in the vertical segment 13*a* thereof As illustrated in phantom in FIG. 5, the cable 31 further extends through the bend 13*c* and angled segment 13*b* in the interior of the hollow support post 13 and through the post coupling 15 (FIG. 8), and downwardly from the vertical segment 14*a* of the support arm 14 through the open bottom end thereof. The cable 31 further extends through the pulley 33 (mounted on the strut support sleeve 24), as illustrated in phantom in FIG. 3, and loops upwardly and re-enters the vertical segment 14*a* of the support arm 14, as illustrated in FIG. 5, where the cable 31 typically terminates in a cable loop (not illustrated) which is typically bolted or otherwise attached to the support arm 14, inside the hollow vertical segment 14*a* thereof Accordingly, in application of the cantilever umbrella 1 as hereinafter described, the canopy support ribs 21 and mounted canopy 39 (FIG. 1) are deployed from the closed configuration illustrated in FIGS. 4 and 5 to the open, shielding configuration illustrated in FIGS. 1 and 2, by rotating the winch crank 30 to wind the cable 31 on the winch spool 29 as the winch spool 29 rotates between the winch mount brackets 27. This action draws the cable 31 through the pulley 33 whole the end of the cable 31 opposite the winch spool 29 remains attached to the interior of the support arm 14, and the shortening cable 31 thus raises the pulley 33 and the attached strut support sleeve 24. Consequently, the spreader struts 22 pivot outwardly in concert on the rising strut support sleeve 24 at the respective connector rods 18 (FIG. 5), and push the respective attached canopy support ribs 21 upwardly as the canopy support ribs 21 pivot outwardly in concert on the canopy support sleeve 17 at the respective connector rods 18 and on the spreader struts 22 at the respective strut connector hooks 23. The canopy 39 is deployed in the closed configuration, as desired, by unwinding the cable 31 from the winch spool 29 by opposite rotation of the winch crank 30, thereby causing the combined weights of the strut support sleeve 24 and pulley 33 to pull downwardly on the lengthening cable 31 at the pulley 33, and the spreader struts 22 to pivot upwardly in concert on the strut support sleeve 24 and pivot on the canopy support ribs 21, and the canopy support ribs 21 to pivot downwardly in concert on the canopy support sleeve 17, as hereinafter further described.

Referring again to FIGS. 1, 2, 4 and 11–13 of the drawings, in typical application of the cantilever umbrella 1 the closed canopy 39 is initially positioned at a selected location in an imaginary circle which is defined by the orbit of the canopy 39 around the support post 13 by rotating the support post 13 in the post seat 6 (FIG. 7) of the base 2. Accordingly, the support post 13 is unlocked for rotation in the base 2 by grasping the handles 8 and initially lifting the attached lock plate 7, resting on the base plate 3 of the base 2 between the hex heads 5 of the respective anchor bolts 4 as illustrated in FIG. 12, from the upper surface of the base plate 3 to disengage the plate notches 10 from the respective post lock flanges 12 of the post lock collar 11, as illustrated in FIG. 11. While the post lock flanges 12 remain clear of the plate notches 10 of the lock plate 7, the lock plate 7 is slightly rotated on the support post 13, and diagonally-opposed corners of the lock plate 7 are rested on the hex heads 5 of the respective anchor bolts 4, as illustrated in phantom in FIG. 13. Accordingly, as indicated by the double-headed arrow in FIG. 11 the support post 13 is capable of rotating in the post seat 6 (FIG. 7) of the base 2 in order to facilitate positioning of the canopy 39 at any position in the imaginary circle defined by the orbit of the closed canopy 39 with the rotating support post 13 around the base 2. When the desired positioning of the canopy 39 is achieved, the support post 13 is locked in the base 2 to prevent inadvertent rotation of the support post 13 in the post seat 6. This is accomplished by repositioning the lock plate 7 as indicated by the solid lines in FIG. 13 to align a diametrically-opposed pair of the plate notches 10 of the lock plate 7 with the respective post lock flanges 12 of the post lock collar 11, and then lowering the lock plate 7 to rest on the base plate 3 while extending the post lock flanges 12 through the respective plate notches 10. It will be appreciated by those skilled in the art that rotational pressure applied to the support post 13 in either direction in the base 2, such as wind pressure applied to the canopy 39, will be resisted by the lock plate 7, since the post lock flanges 12 engage the lock plate 7 at the plate notches 10, and this action causes the corresponding pair of diagonally-opposed corners of the lock plate 7 to engage the hex heads 5 of the respective pair of anchor bolts 4, as illustrated in FIGS. 12 and 13. The canopy 39 of the cantilever umbrella 1 is next opened as heretofore described with respect to FIGS. 4 and 5, by rotating the winch crank 30 to wind the cable 30 on the winch spool 29 and lift the strut support sleeve 24 by operation of the pulley 33 and deploy the canopy support ribs 21 and spreader struts 22 from the closed configuration illustrated in FIGS. 4 and 5 to the open configuration illustrated in FIGS. 1 and 2. Conversely, the canopy 39 is closed by rotating the winch crank 30 in the opposite direction to unwind the cable 30 from the winch spool 29 and deploy the canopy support ribs 21 and spreader struts 22 from the open configuration illustrated in FIGS. 1 and 2 to the closed configuration illustrated in FIGS. 3 and 4, as heretofore described.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, what is claimed is:

1. A cantilever umbrella comprising a base; a support post carried by said base; a canopy support element supported in cantilever configuration on said support post, said canopy support element disposed in substantially fixed, non-tiltable relationship with respect to said support post; a plurality of canopy support ribs pivotally engaging said canopy support element and extending from said canopy support element in substantially radially-extending relationship; a canopy mounted on said canopy support ribs; a plurality of spreader struts pivotally engaging said plurality of canopy support ribs, respectively; a strut support element pivotally carried by said plurality of spreader struts; a pulley provided on said strut support element; a winch mounted on said support post; and a cable engaging said winch and said pulley, whereby said cable lifts said strut support element, said spreader struts pivot in concert on said strut support element and said support ribs, respectively, and said support ribs pivot in concert on said canopy support element to open said canopy responsive to operation of said winch.

2. The cantilever umbrella of claim 1 comprising a support arm carried by said support post and wherein said canopy support element is mounted on said support arm.

3. The cantilever umbrella of claim 1 wherein said cable has a first end attached to said winch and a second end disposed above said pulley, and extends through said pulley between said first end and said second end of said cable.

4. The cantilever umbrella of claim 3 comprising a support arm carried by said support post and wherein said canopy support element is mounted on said support arm.

5. The cantilever umbrella of claim 1 wherein said support post is rotatably mounted in said base, and comprising a post lock mechanism carried by said support post for removably engaging said base and selectively preventing rotation of said support post in said base.

6. The cantilever umbrella of claim 5 comprising a support arm carried by said support post and wherein said canopy support element is mounted on said support arm.

7. The cantilever umbrella of claim 5 wherein said cable has a first end attached to said winch and a second end disposed above said pulley, and extends through said pulley between said first end and said second end of said cable.

8. The cantilever umbrella of claim 7 comprising a support arm carried by said support post and wherein said canopy support element is mounted on said support arm.

9. The cantilever umbrella of claim 1 wherein said base comprises a base plate and a post seat extending beneath said base plate for receiving said support post.

10. The cantilever umbrella of claim 9 comprising a support arm carried by said support post and wherein said canopy support element is mounted on said support arm.

11. The cantilever umbrella of claim 9 wherein said cable has a first end attached to said winch and a second end disposed above said pulley, and extends through said pulley between said first end and said second end of said cable.

12. The cantilever umbrella of claim 11 comprising a support arm carried by said support post and wherein said canopy support element is mounted on said support arm.

13. The cantilever umbrella of claim 9 wherein said support post is rotatably mounted in said post seat of said base, and comprising a post lock mechanism carried by said support post for removably engaging said base plate of said base and selectively preventing rotation of said support post in said base.

14. The cantilever umbrella of claim 13 comprising a support arm carried by said support post and wherein said canopy support element is mounted on said support arm.

15. The cantilever umbrella of claim 13 wherein said cable has a first end attached to said winch and a second end disposed above said pulley, and extends through said pulley between said first end and said second end of said cable.

16. The cantilever umbrella of claim 15 comprising a support arm carried by said support post and wherein said canopy support element is mounted on said support arm.

17. A cantilever umbrella comprising a base; a support post carried by said base; a support arm extending from said support post; a canopy support sleeve provided on said support arm, said canopy support sleeve disposed in substantially fixed, non-tiltable relationship with respect to said support post; a plurality of canopy support ribs pivotally engaging said canopy support sleeve and extending from said canopy support sleeve in substantially radially-extending relationship; a canopy mounted on said canopy support ribs; a plurality of spreader struts pivotally engaging said plurality of canopy support ribs, respectively; a strut support sleeve pivotally carried by said plurality of spreader struts; a pulley provided on said strut support sleeve; a winch mounted on said support post; and a cable having a first end engaging said winch and a second end engaging said support arm, said cable engaging said pulley, whereby said cable lifts said strut support sleeve, said spreader struts pivot on said strut support sleeve and said support ribs, respectively, and said support ribs pivot on said canopy support sleeve to open said canopy, responsive to operation of said winch.

18. The cantilever umbrella of claim 17 wherein said support post is rotatably mounted in said base, and comprising a post lock mechanism carried by said support post for removably engaging said base and selectively preventing rotation of said support post in said base.

19. The cantilever umbrella of claim 18 wherein said base comprises a base plate and a post seat provided beneath said base plate for receiving said support post.

20. A cantilever umbrella comprising a base; a support post rotatably mounted in said base; a pair of post lock flanges protruding from said support post in spaced-apart relationship to each other, a lock plate removably engaging said base and a plurality of plate notches provided in said lock plate for receiving said pair of post lock flanges, respectively, whereby said lock plate prevents rotation of said support post in said base when said lock plate engages said base; a canopy support element supported in cantilever configuration on said support post; a plurality of canopy support ribs pivotally engaging said canopy support element and extending from said canopy support element in radially-extending relationship; a canopy mounted on said canopy support ribs; a plurality of spreader struts pivotally engaging said plurality of canopy support ribs, respectively; a strut support element pivotally carried by said plurality of spreader struts; a pulley provided on said strut support element; a winch mounted on said support post; and a cable engaging said winch and said pulley, whereby said cable lifts said strut support element, said spreader struts pivot in concert on said strut support element and said support ribs, respectively, and said support ribs pivot in concert on said canopy support element to open said canopy, responsive to operation of said winch.

* * * * *